US007581611B1

(12) United States Patent
Kratz

(10) Patent No.: US 7,581,611 B1
(45) Date of Patent: Sep. 1, 2009

(54) TWO-WHEEL VEHICLE WITH A TILT MECHANISM AND STABILITY MECHANISM

(75) Inventor: Ryan Kratz, Oak Park, IL (US)

(73) Assignee: Rehco, LLC, Chicago, IL (US)

( * ) Notice: Subject to any disclaimer, the term of this patent is extended or adjusted under 35 U.S.C. 154(b) by 279 days.

(21) Appl. No.: 11/835,074

(22) Filed: Aug. 7, 2007

Related U.S. Application Data

(63) Continuation-in-part of application No. 11/144,997, filed on Jun. 3, 2005, now Pat. No. 7,337,862.

(51) Int. Cl.
*B62K 17/00* (2006.01)

(52) U.S. Cl. ..... 180/222; 180/224

(58) Field of Classification Search ..... 180/220–224, 180/230
See application file for complete search history.

(56) References Cited

U.S. PATENT DOCUMENTS 4,902,271 A 2/1990 Yoneda
4,966,569 A 10/1990 Asano
5,820,439 A 10/1998 Hair, III
7,293,623 B2 * 11/2007 Berkelmans ..... 180/205
2006/0009119 A1 1/2006 Hoeting et al.
2006/0121824 A1 6/2006 Lee et al.

FOREIGN PATENT DOCUMENTS

JP 2004-298237 10/2004

* cited by examiner

*Primary Examiner*—Christopher P Ellis
*Assistant Examiner*—Jabob Knutson
(74) *Attorney, Agent, or Firm*—Adam K Sacharoff; Much Shelist

(57) ABSTRACT

In accordance with one embodiment of the present invention a two-wheel vehicle is provided. The vehicle includes a pair of wheel housings, each wheel housing having an inner circumference and an outer circumference, and further having an annular gear rack being positioned on the inner circumference and a wheel secured on the outer circumference. A motor mechanism drives a gear train that is meshed to the annular gear racks. A chassis is connected to a frame and interconnects the pair of wheel housings to the frame such that the frame moves independently from the pair of wheel housings. A tilting mechanism tilts the frame about the chassis such that the vehicle turns in the direction of the tilt. A stabilizing mechanism, when the frame is tilting, counteracts the forces on the vehicle to assist in maintaining an upright position while the vehicle is turning.

20 Claims, 7 Drawing Sheets

10

200

TWO-WHEEL VEHICLE WITH A TILT MECHANISM AND STABILITY MECHANISM

CROSS REFERENCE TO RELATED APPLICATION

The present invention is a continuation in part of U.S. application Ser. No. 11/144,997 filed on Jun. 3, 2005.

FIELD OF THE INVENTION

The present invention relates to a powered two-wheel vehicle that includes a tilt mechanism and a stability mechanism that direct the vehicle to turn while the two wheels are rotating and in contact with a surface.

BACKGROUND OF THE INVENTION

The concepts and designs of motorcycles have seen many developments since it's original inception. As electronics and mechanical developments have improved, the motorcycle continues to improve in performance. Another result of these developments is a market for smaller radio controlled versions for children and adults to utilize in a scaled down version for entertainment. When motorcycles are designed for human transportation, great care must be taken to ensure the external forces acting on the rider and vehicle are balanced. The active inputs and movements executed by a rider on a motorcycle to achieve a balanced ride carry over to the design of toy and radio controlled versions of two wheeled vehicles. These balance principles are still necessary to achieve a quality performance experience from a user, but are addressed with various mechanisms to counter external forces acting on the toy and radio controlled versions. Additionally, a segment of motor sports has gained popularity in which vehicles "drift" or "slide" through turns. This segment involves over-steering principles where a driver or rider enter turns at high speeds and then drifts through the corner while preserving a high exit speed. Principles involving the vehicle traction in combination with steering mechanics and weight elements dictate the success of drifting while moving.

U.S. Pat. No. 4,342,175 discloses a two-wheeled motorcycle with a frame carrying a drive motor, a servo controlled by a radio and a power source for driving the motor. The motorcycle is rear wheel driven and the front fork of the motorcycle is rotatably attached to a front wheel and a steering mechanism is attached to the top portion of the front fork which is pivotally attached to the frame of the motorcycle, such that when the center of gravity is shifted, the steering mechanism will tend to turn the front wheel in the same direction.

U.S. Pat. No. 4,290,228 discloses a two-wheeled toy motorcycle with side supports attached to two outriggers to bank the toy for negotiating turns. The front wheel is pivotally attached to a front fork with a steering mechanism to direct the toy's turning direction. The outriggers are cam operated from the steering mechanism and the side supports engage the surface on which the toy rests to prevent the toy from falling over sideways. However, the design is such that during operation of the toy one of the side supports will most likely be in contact with the surface, which diminishes the performance and realistic appeal of the toy. Further, the addition of a steering mechanism on the front fork creates added mechanical complexity that increases the cost of the toy while increasing the possibility of mechanical failure.

As one can appreciate from the examples above, prior two-wheeled toy vehicles have mechanically complicated steering configurations and have been lacking in delivering a realistic radio controlled driving experience to an adult or child. Further, the examples require a certain level of traction for the wheels and a surface in order to perform as desired.

One or more of the embodiments provided herein improve on past two-wheeled vehicle designs and solves the problems of stability and performance with a durable and efficient radio controlled two-wheeled vehicle with a simplistic design that takes advantage of external forces acting on a vehicle along with the physical characteristics of the two-wheeled vehicle. This quality of this vehicles performance relies on fewer variables and parts while powering both wheels and as such provides utilization on several different types of surfaces. Further, this invention provides a user with the capability to simulate a performance style known in motor sports as drifting.

SUMMARY OF THE INVENTION

In accordance with one embodiment of the present invention there is provided a two wheeled vehicle. The vehicle includes a pair of wheel housings. An annular gear rack is positioned on the inner circumference of the wheel housing and a wheel is secured on the outer circumference of the wheel housing. A chassis is connected to a frame and interconnects the pair of wheel housings to the frame such that the frame moves independently from the pair of wheel housings. A means for rotating the wheel housings by rotating the annular gear racks is also provided. A means for tilting the frame about the chassis when the wheel housings are rotating is further provided. The tilting frame causes a change in the center of gravity of the vehicle, wherein the change in the center of gravity causes forces acting on the vehicle to turn the vehicle towards changing center of gravity. In addition, a means for stabilizing the vehicle when the frame is tilting about the chassis and the vehicle is moving is also provided. The stabilizing means counteracts the forces acting on the vehicle opposite the turn and to assist in maintaining an upright position while the vehicle is turning.

In another embodiment the means for tilting the frame includes a tilt mechanism pivotally secured between the frame and the chassis. The tilt mechanism may also include a servo that is remotely controlled.

In another embodiment the means to provide vehicle stability includes a pair of protrusions defined on a base of the tilt mechanism, a pair of legs extending from a subframe member, which is pivotally attached to the tilting mechanism, each leg includes a tab defined on an upper portion thereof and a skid pad on a lower portion thereof. In addition, a pair of spring activated return mechanisms are separately positioned between the subframe member and one of the legs. In this embodiment when the tilt mechanism tilts, a protrusion opposite the tilt pushes against one of the tabs to engage and pivot one of the legs such that the skid pad is moved to a lower position, whereby the lowering of one of the legs acts to counterbalance forces exerted on the vehicle opposite the direction of the turn.

In another embodiment the two wheels have an outer surface with low surface friction and the low surface friction is such that the wheels are able to slip while spinning. The low surface friction causes the vehicle to turn in a drifting movement.

In another embodiment the means for rotating the two wheels includes at least one motor secured within one of the wheel housings. The motor drives a gear train which is meshed to the annular racks.

In another embodiment the vehicle is defined as having front and rear forks in both wheel housing with an axle defined in each fork. A motor drives a gear train that is meshed with outer gears that are secured onto the axle and therefore rotate the wheels when driven.

User inputs to a controller direct a transfer of power via a circuit board secured within the vehicle and a receiver in communication with the circuit board. The controller sends commands to the receiver, such that the circuit board can adjust a speed of the vehicle and adjust the tilting mechanism in response to the commands.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1A:
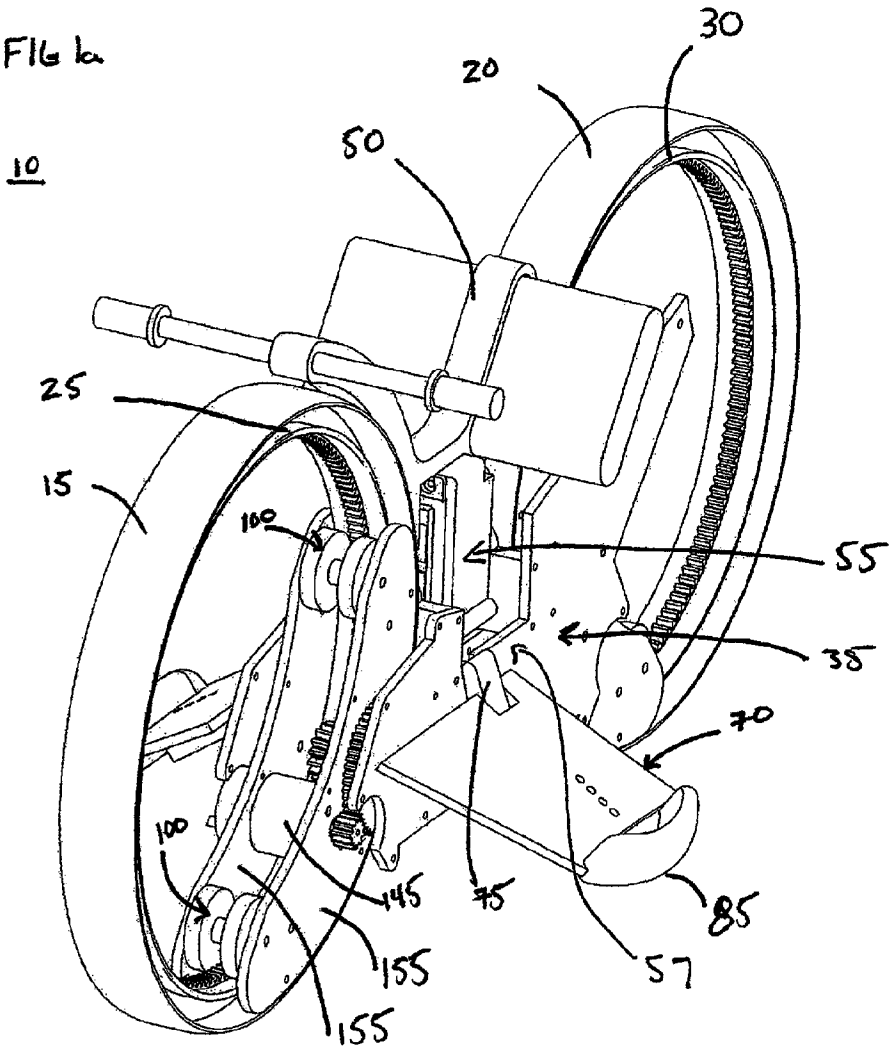
FIG. 1*a* is a perspective view of a first embodiment of a two-wheel vehicle in accordance with the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims to the embodiments illustrated.

Figure 1B:
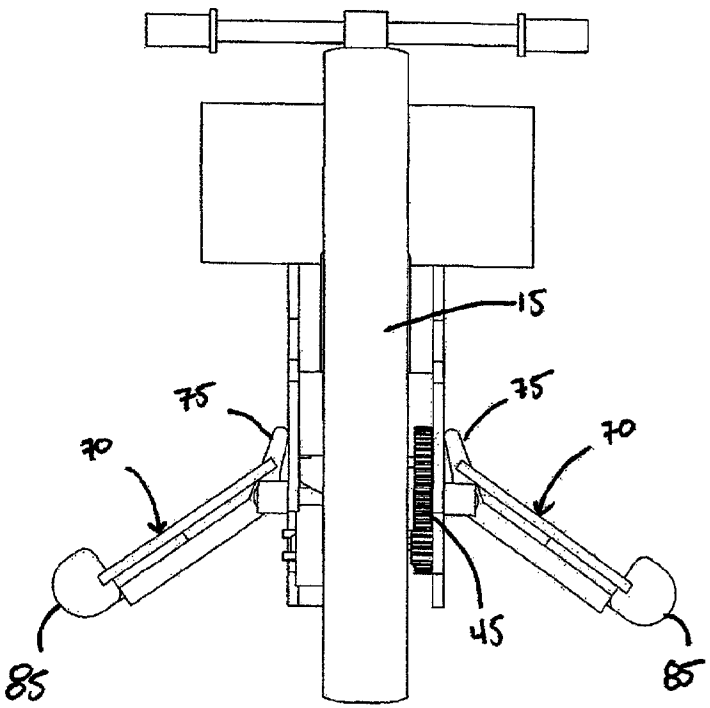
FIG. 1*b* is a front view of FIG. 1*a;*
Figure 2A:
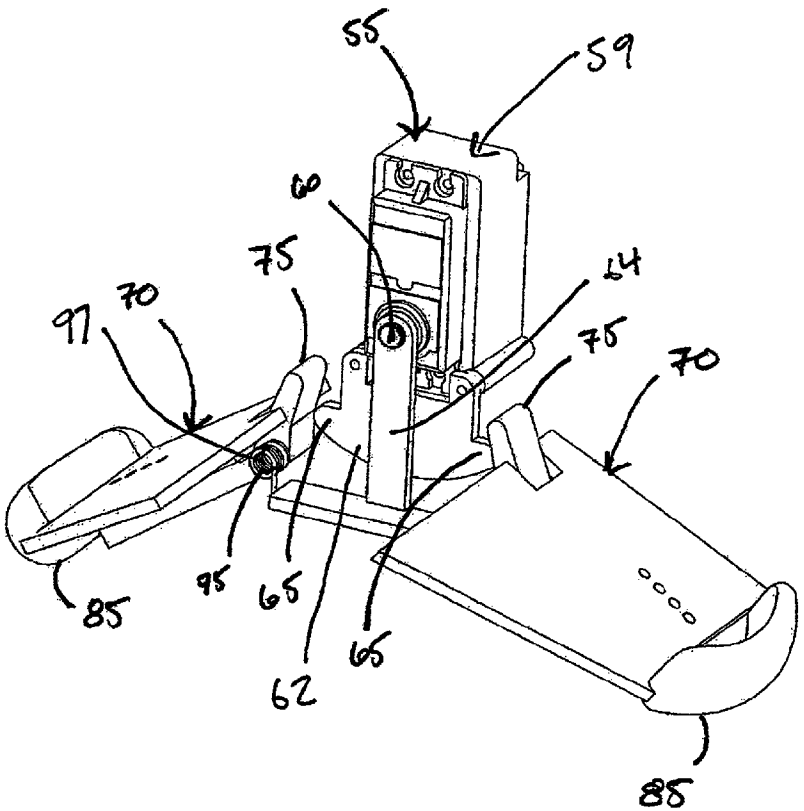
FIG. 2*a* is a perspective view of a tilt mechanism and stability mechanism included in a first and second embodiment of a two-wheel vehicle in accordance with the present invention.
Figure 2B:
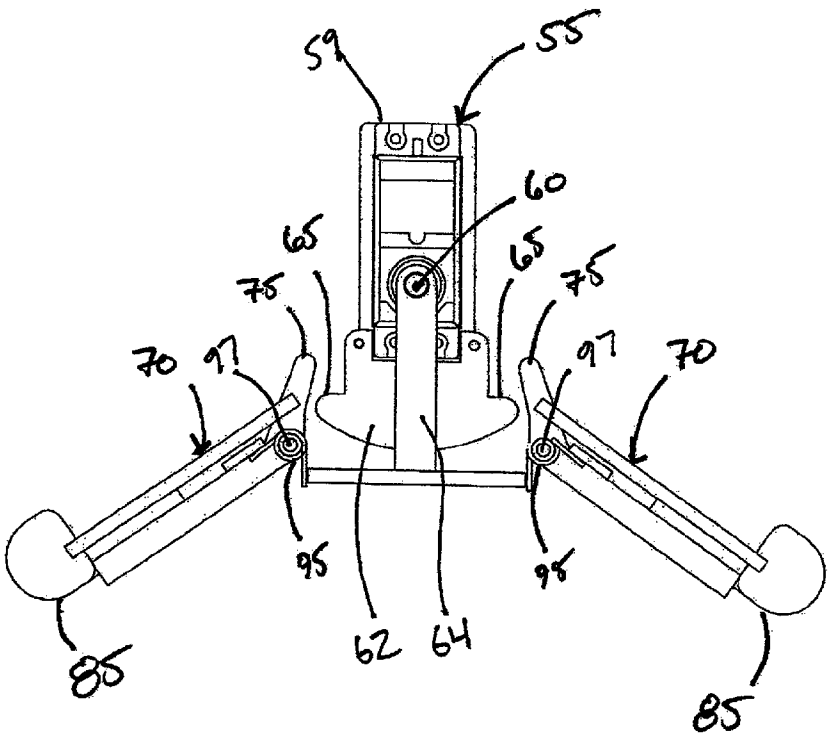
FIG. 2*b* is a front view of FIG. 2*a;*
Figure 2C:
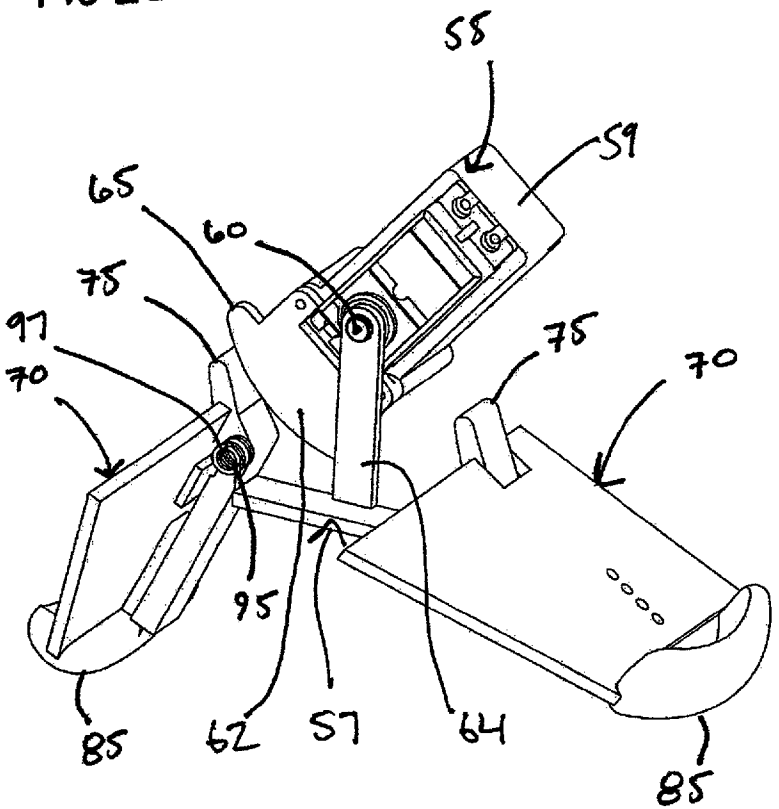
FIG. 2*c* is a perspective view of a tilt mechanism and stability mechanism illustrating the tilt mechanism engaging the stability mechanism when the tilt mechanism pivots during a turn.
Figure 2D:
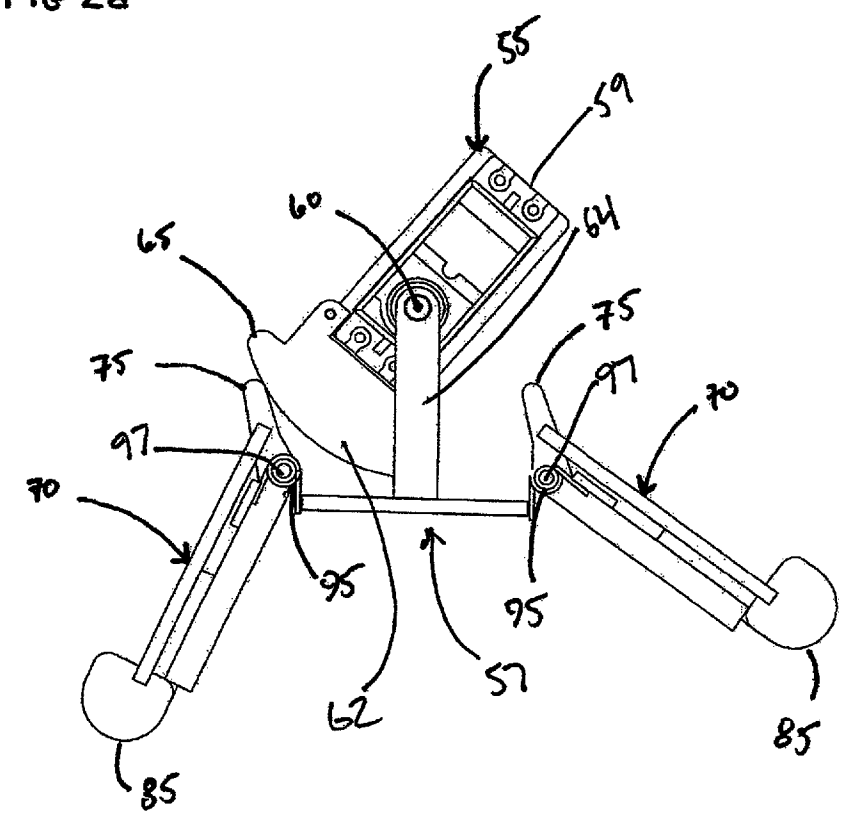
FIG. 2*d* is a front view of FIG. 2*c;*

Referring now to FIGS. 1*a* and 1*b*, there is shown a two-wheeled vehicle 10. The vehicle 10 includes a front wheel 15 and a rear wheel 20 secured to a rotatable front wheel housing 25 and a rear wheel housing 30, respectively, such that when the front and rear wheels housings rotate, the front and rear wheels rotate therewith. Both the front wheel housing 25 and the rear wheel housing 30 are separately secured to a chassis 35 through a gear train 45, which is further operably connected to a motor (discussed in greater detail below) for driving and thus rotating the front and rear wheels. The chassis 35 is connected to a frame 50 and interconnects the wheel housings to the frame such that the frame moves independently from the wheel housings. Also included are a first means 55 for tilting the frame 50 and a second means 57 for stabilizing the frame 50 while tilting.

Referring now also to FIGS. 2*a* through 2*d* the first means 55 for tilting the frame 50 and the second means 57 for stabilizing the frame 50 are mechanically illustrated. The first means 55 for tilting the frame includes a tilt mechanism 59 pivotally connected at an axis 60 to a subframe member 64. The subframe member 64 is secured to the chassis 35. Therefore, the frame 50 is secured to the tilt mechanism 55, which is further pivotally secured to the chassis 35.

The tilt mechanism 59 also includes a servo remotely controlled by a hand-held remote control unit (not shown). The servo is operably connected to the frame 50 and pivots about the axis 60. A servo motor pivots the tilt mechanism 55 when controlled by the remote controller unit (not shown). The tilt mechanism 55 includes a servo housing secured to the frame 50. The servo motor is pivotally connected to a servo axle on axis 60 that is secured to the chassis 35. The servo motor within the servo housing drives a servo gear train causing the tilt mechanism 55 to pivot on the servo axle and thus causing the tilt mechanism 55 to lean to one side or the other. A character or figure may optionally be secured to the frame 50. The tilt mechanism 55 may also include a variable resistor that determines when the tilt mechanism 55 is centered and determines the degree of tilt. The degree of tilt dictates the sharpness or softness of the turns. Other well known means to locate a center position and other tilt positions may be used.

The second means 57 for stabilizing the frame 50 while the vehicle 10 is turning, is defined by providing a stability mechanism. The stability mechanism includes a pair of protrusions 65 extending from opposite ends of the base 62 defined by the tilt mechanism 59. The stability mechanism further includes a pair of legs 70 pivotally secured a spring activated return mechanism 95. The spring activated return mechanism 95 is attached to the subframe member 64. Each of the two legs 70 includes a tab 75 and a skid pad 85.

Figure 3A:
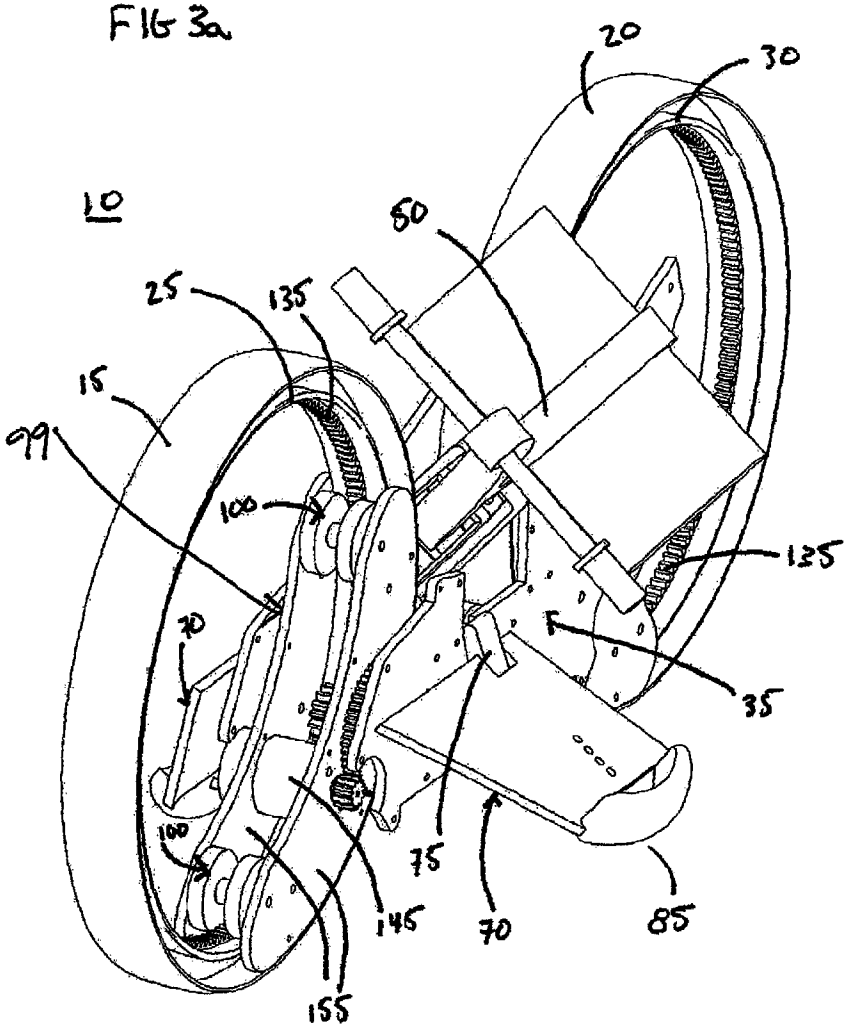
FIG. 3*a* is a perspective view of a first embodiment of a two-wheel vehicle in accordance with the present invention illustrating the frame of the vehicle is tilted to one side.
Figure 3B:
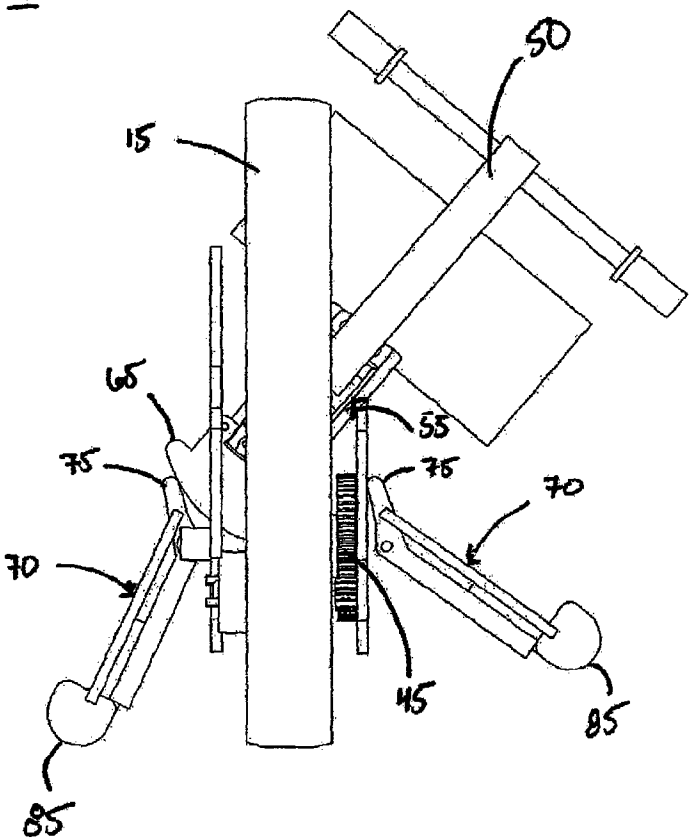
FIG. 3*b* is a front view of FIG. 3*a* illustrating a tilt mechanism engaging a stability mechanism where a tilt mechanism tilts the frame to one side.

To turn the vehicle 10, a user remotely pivots the tilt mechanism 55 about the pivot axis 60. The center of gravity of the vehicle 10 will shift with the pivoting of the tilt mechanism 55. The shifting of the center of gravity towards one side will add a torque to the angular momentum defined in the moving vehicle 10, causing the vehicle to lean towards (or turn) into the side of the center of gravity shift. This is done in order to maintain and conserve the angular momentum of the vehicle 10. When the tilt mechanism 55 pivots, the protrusion 65 on the opposite side of the lean contacts and pushes the corresponding tab 75. The corresponding tab 75 when pushed pivots its attached leg 70 about a pivot point 97 moving the skid pad 85 downwardly (further illustrated in FIGS. 3*a* and 3*b*). The lowered positioning of the leg 70 assists in counterbalancing forces exerted on the vehicle 10 that would normally pull the vehicle in a direction opposite to the desired turning direction. As such, the tilt mechanism 55 and the stability mechanism 57 counterbalance the forces exerted on the vehicle 10 to provide a user to direct the vehicle 10 to perform a number of driving maneuvers and tricks. One such performance example deals with a steering and performance style known as "drifting." Drifting refers to a driving and/or riding technique to proceed through a turn with a vehicle such as a car or motorcycle. Over-steering principles are used such that a driver or rider enter a turn at a high speed and then drift through the corner while preserving a high exit speed. In this invention, the two-wheel vehicle 10 drifts by intentionally losing lateral wheel grip while using steering (in this case, utilizing the tilt mechanism 55 to shift the weight of the vehicle 10) and throttle inputs to direct the vehicle 10 through a turn. In addition, the front wheel 15 and rear wheel 20 may be made of materials with a low surface friction to help enable a drifting effect through a turn while maintaining speed.

The speed or rate of rotation of the front wheel 15 and the rear wheel 20 are controlled with the remote control unit (not shown). The remote control unit also controls the degree of pivoting of the tilt mechanism 55. It should be appreciated that the higher degree of pivoting the sharper the turn. The remote control unit may use infra red, radio waves, optical sensors or other well-known communication means. The front wheel 15 and the rear wheel 20 may both have a flat surface on the outer circumference to enable the vehicle to stand in a vertical position (when not moving) without support from an outside source. Both wheels are secured to their respective rotatable wheel housings, such that both wheels are able to spin while the chassis 35 remains in a constant position if so desired.

Figure 4:
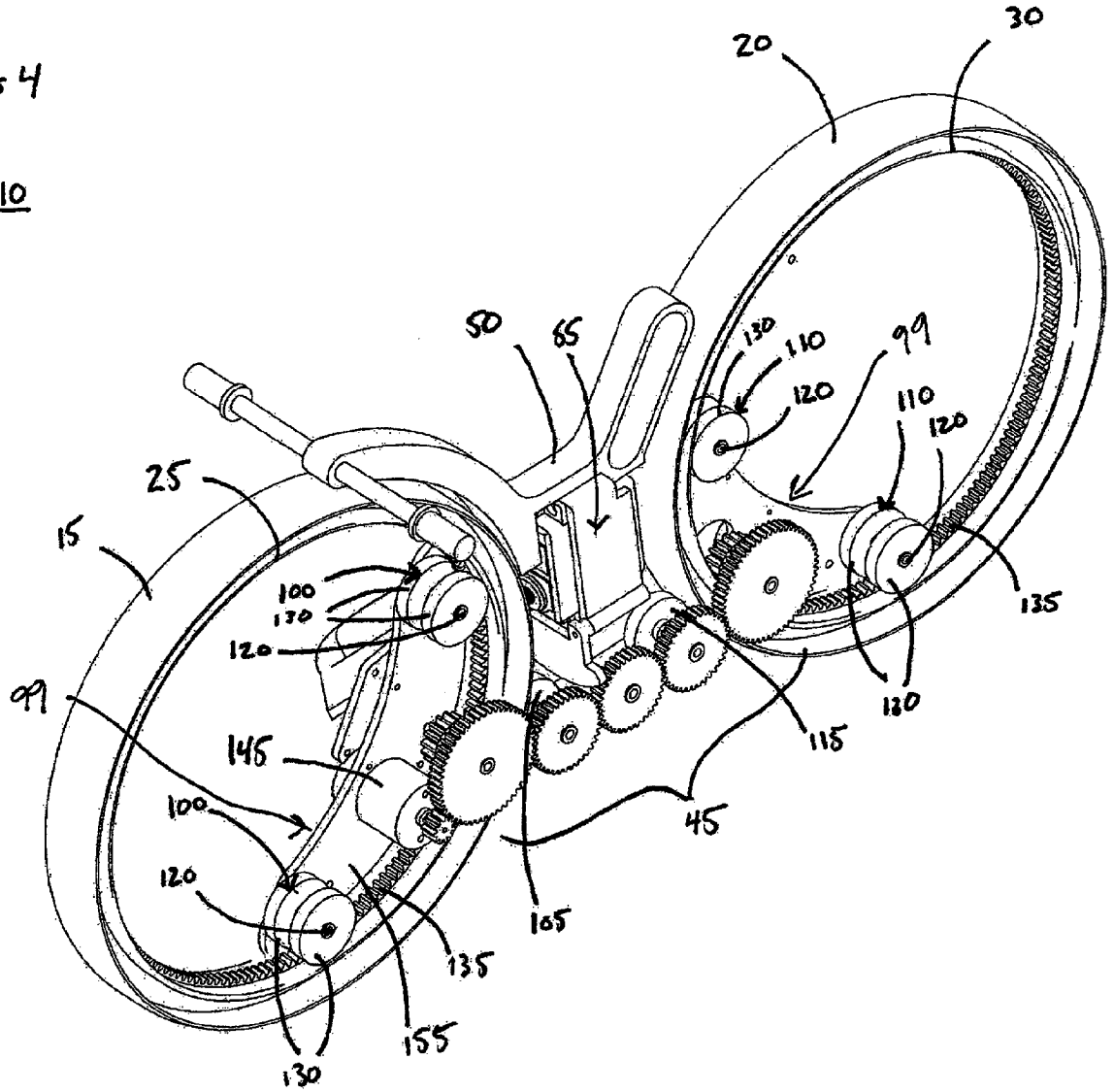
FIG. 4 is a perspective view of a first embodiment of a two-wheel vehicle in accordance with the present invention where the housings are removed, illustrating the drive motor and transfer gear train relationship.

Now referring to FIGS. 1*a* and 4, the means to rotate the wheels includes a drive motor 145 secured within the front wheel housing 25. The drive motor drives a gear train 45 that is meshed to a pair of gear racks 135, separately positioned on the inner circumference of the wheel housings. The drive motor 145 sits in a motor housing defined by two side plates 155 included in the front wheel housing 25. The drive motor or a second drive motor may also be positioned in the rear wheel housing if desired. When the drive motor 145 is operating, the gear train 45 distributes an equal amount of power to drive the front wheel 15 and the rear wheel 20, and may be driven in either a forward or reverse direction. Balance of the rotating wheels is further accomplished by providing multiple points of contact with the wheel housing defined as guides 99. Each guide 99 has three points of contact with its respective wheel housing. However, more or less contact points may be utilized without deviating from the scope of the invention; in fact it is further contemplated that the present embodiments may not include guides at all. On the front wheel 15, two of the points of contact are positioned on the inner circumference of the front wheel housing 25 at a pair of front inner positioning wheels 100 and the third point of contact is a front outer positioning wheel 105 located on the outer circumference of the front wheel 15. On the rear wheel 20, two of the points of contact are positioned on the inner circumference of the rear wheel housing 30 at a pair of rear inner positioning wheels 110 and the third point of contact is a rear outer positioning wheel 115 located on the outer circumference of the rear wheel housing 30. Both pairs of positioning wheels 105 and 110 spin on axles 120 secured to the corresponding housing, while the outer positioning wheels spin on axles external to the wheels and secured to the chassis 35. Both sets of the inner positioning wheels include two cylindrical discs 130 having a space therebetween to receive gear racks 135.

During operation, the front wheel 15 and rear wheel 20 rotate making contact with a surface to propel the vehicle 10. As the speed of the rotating wheels increases, gyroscopic forces and the angular momentum of the wheels keep the vehicle 10 upright. In addition, when the speed decreases, inertia of the rotating wheels also keep the vehicle upright.

Figure 5:
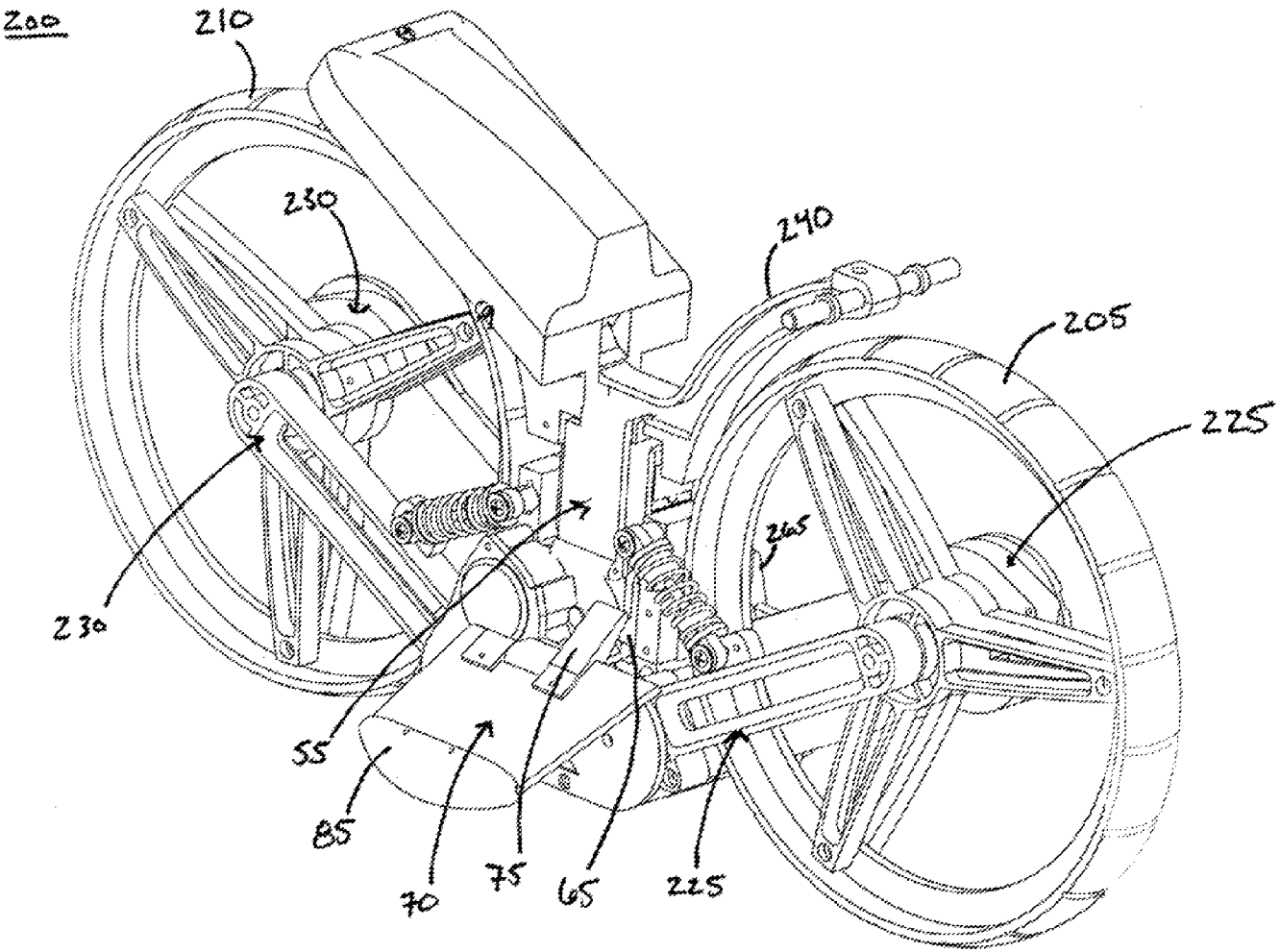
FIG. 5 is a perspective view of a second embodiment of a two-wheel vehicle in accordance with the present invention.
Figure 6:
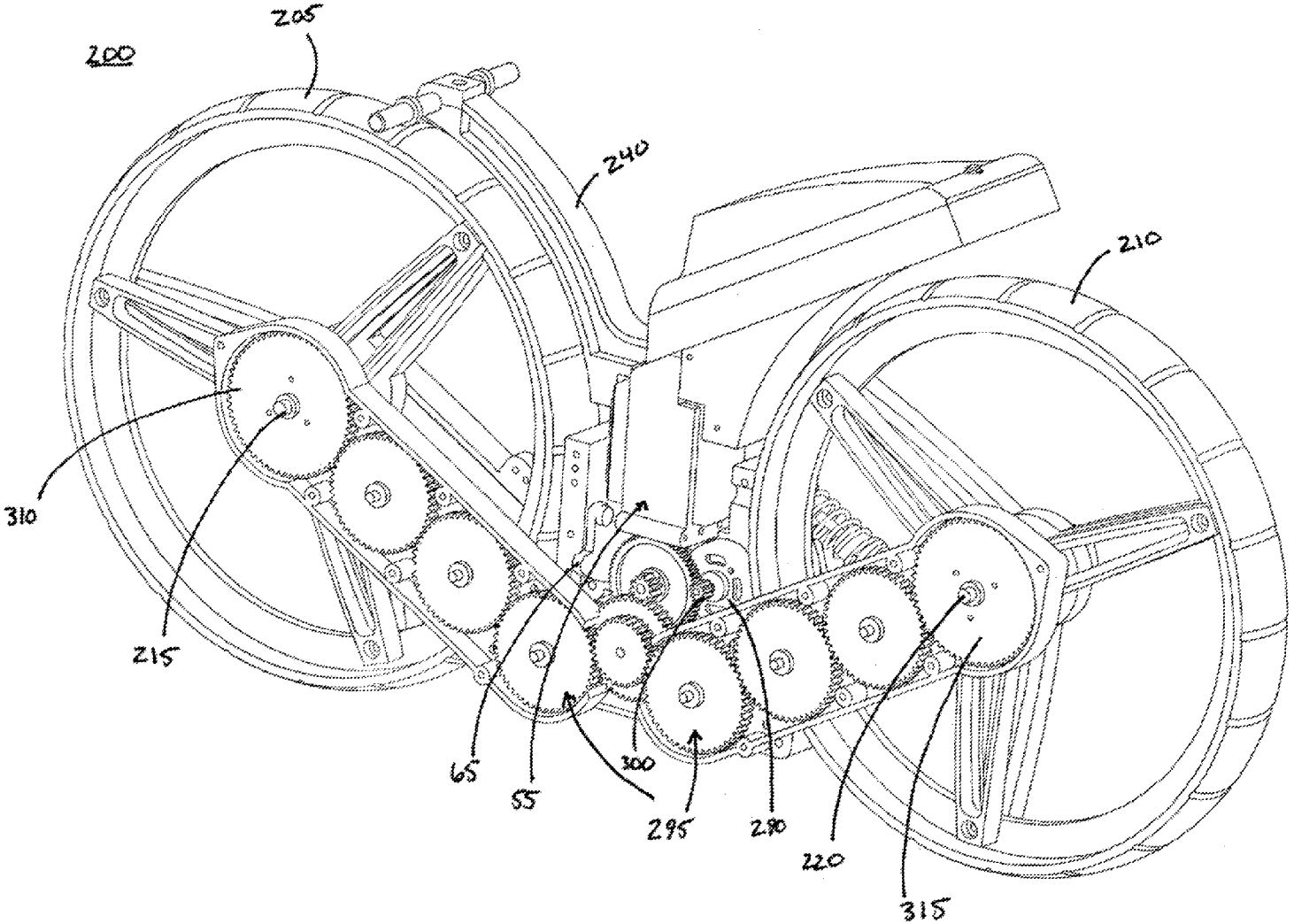
FIG. 6 is a perspective view of a second embodiment of a two-wheel vehicle in accordance with the present invention where a housing is removed, illustrating the drive motor and transfer gear train relationship.

In a second embodiment as illustrated in FIGS. 5 and 6, there is a two-wheeled vehicle 200. The vehicle 200 includes a chassis with a front fork 225 and a rear fork 230, a front wheel 205 and a rear wheel 210 rotatably secured to a front axle 215 and a rear axle 220, respectively. The front axle 215 is secured to the front fork 225 and the rear axle 220 is secured to the rear fork 230. Further, a means for rotating the front wheel 205 and the rear wheel 210 is secured to the chassis. The chassis is connected to a frame 240 and interconnects the wheel housings to the frame such that the frame moves independently from the wheel housings.

During operation, the front wheel 205 and rear wheel 210 rotate making contact with a surface to propel the vehicle 200. As the speed of the rotating wheels increases, gyroscopic forces and the angular momentum of the wheels keep the vehicle 200 upright. In addition, when the speed decreases, inertia of the rotating wheels also keep the vehicle 200 upright. The tilting and stabilizing means described above are utilized in the same manner for the second embodiment and thus further comment is not provided.

Continuing to referring to FIGS. 5 and 6, a means for rotating the front wheel 205 and the rear wheel 210 includes a drive motor 290 that drives a gear train 295. The drive motor 290 has a drive gear 300 and is secured within a motor housing. The drive gear 300 is meshed with the gear train 295 to transfer power. The gear train 295 is meshed with a front axle gear 310 and a rear axle gear 315. The front axle gear 310 is rotatably secured to the front axle 215 and the rear axle gear 315 is rotatably secured to the rear axle 220, such that power is transferred from the transfer gear train 295 to both the front axle 215 and rear axle 220 to drive the front wheel 205 and rear wheel 210 in either a forward or reverse direction.

It is also important to note that the embodiments disclosed herein cover a radio controlled two-wheeled vehicle, that utilizes the combination of two wheels and a tilt mechanism for movement where the wheels are powered for forward and rearward movement and where the tilt mechanism adjusts the center of gravity of the vehicle to turn in the left and right directions. In addition, the vehicle's movement is radio controlled by a user. It should be further noted that while the embodiments disclose a flat surface and a rounded surface for the wheel, the present invention may also utilize other surfaces with different textures and shapes.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or inferred. It is intended to cover by the appended claims all such modifications as fall within the scope of the claims.

I claim:

1. A vehicle comprising:

a pair of wheel housings, each wheel housing having an inner circumference and an outer circumference, and further having an annular gear rack being positioned on the inner circumference and a wheel secured on the outer circumference;

a chassis being connected to a frame and interconnecting the pair of wheel housings to the frame such that the frame moves independently from the pair of wheel housings;

a means for rotating the wheel housings by rotating the annular gear racks;

a means for tilting the frame about the chassis, when the wheel housings are rotating, such that the tilting frame causes a change in the center of gravity of the vehicle, wherein the change in the center of gravity causes forces acting on the vehicle to turn the vehicle towards changing center of gravity; and a means for stabilizing the vehicle when the frame is tilting about the chassis and the vehicle is moving, the stabilizing means counteracting the forces acting on the vehicle opposite the turn and to assist in maintaining an upright position while the vehicle is turning.

2. The vehicle of claim 1 wherein said means for tilting the frame includes a tilt mechanism pivotally secured between the frame and the chassis.

3. The vehicle of claim 2 wherein the tilt mechanism includes a servo.

4. The vehicle of claim 3 wherein said servo is remotely controlled.

5. The vehicle of claim 4 wherein said means to provide vehicle stability comprises:

a pair of protrusions defined on a base of the tilt mechanism;

a pair of legs extending from a subframe member, which is pivotally attached to the tilting mechanism, each leg, of the pair of legs, including a tab defined on an upper portion thereof and a skid pad on a lower portion thereof; and a pair of spring activated return mechanisms separately positioned between the subframe member and one of the legs, of the pair of legs, wherein when said tilt mechanism tilts, a protrusion, of the pair of protrusions, opposite the tilt pushes against one of the tabs to engage and pivot one of the legs such that the skid pad is moved to a lower position, whereby said lowering of one of the legs acts to counterbalance forces exerted on the vehicle opposite the direction of the turn.

6. The vehicle of claim 5, wherein said two wheels have an outer surface with low surface friction.

7. The vehicle of claim 6, wherein said low surface friction is such that the wheels are able to slip while spinning such that when the vehicle is moving, changing the center of gravity of the vehicle directs the vehicle to turn in a drifting movement.

8. The vehicle of claim 1, wherein the means for rotating the two wheels includes at least one motor secured within one of the wheel housings, the motor drives a gear train which is meshed to the annular racks.

9. The vehicle of claim 1, wherein said wheel has a rounded outer surface.

10. A vehicle comprising:

a pair of wheel housings, each wheel housing having a fork with an axle and further having a wheel secured on an outer circumference defined thereby;

a chassis being connected to a frame and rotatably connected to the pair of wheel housings via the axles, the chassis further connecting the wheel housings to the frame such that the frame moves independently from the pair of wheel housings;

a means for rotating the wheel housings about the axles;

a means for tilting the frame about the chassis, when the wheel housings are rotating, such that the tilting frame causes a change in the center of gravity of the vehicle, wherein the change in the center of gravity causes forces acting on the vehicle to turn the vehicle towards changing center of gravity; and a means for stabilizing the vehicle when the frame is tilting about the chassis and the vehicle is moving, the stabilizing means counteracting the forces acting on the vehicle opposite the turn and to assist in maintaining an upright position while the vehicle is turning.

11. The vehicle of claim 10 wherein said means for tilting the frame includes a tilt mechanism pivotally secured between the frame and the chassis.

12. The vehicle of claim 11, wherein said tilt mechanism includes a servo.

13. The vehicle of claim 12, wherein said servo is remotely controlled.

14. The vehicle of claim 13 wherein said means to provide vehicle stability comprises:

a pair of protrusions defined on a base of the tilt mechanism;

a pair of legs extending from a subframe member, which is pivotally attached to the tilting mechanism, each leg, of the pair of legs, including a tab defined on an upper portion thereof and a skid pad on a lower portion thereof; and a pair of spring activated return mechanisms separately positioned between the subframe member and one of the legs, of the pair of legs, wherein when said tilt mechanism tilts, a protrusion, of the pair of protrusions, opposite the tilt pushes against one of the tabs to engage and pivot one of the legs such that the skid pad is moved to a lower position, whereby said lowering of one of the legs acts to counterbalance forces exerted on the vehicle opposite the direction of the turn.

15. The vehicle of claim 14, wherein said two wheels have an outer surface with low surface friction.

16. The vehicle of claim 15, wherein said low surface friction is such that the wheels are able to slip while spinning such that when the vehicle is moving, changing the center of gravity of the vehicle directs the vehicle to turn in a drifting movement.

17. The vehicle of claim 10, wherein the means for rotating the two wheels includes at least one motor secured within the chassis, the motor drives a gear train which is meshed to the outer gears secured to the axles.

18. An improved two wheeled remote control vehicle, the improvement comprising:

a driving mechanism to rotate each of said wheels;

a chassis being connected to a frame and interconnecting the two wheels to the frame such that the frame moves independently from a pair of wheel housings;

a means for tilting the frame about the chassis, when the wheels are rotating, such that the tilting frame causes a change in the center of gravity of the vehicle, wherein the change in the center of gravity causes forces acting on the vehicle to turn the vehicle towards changing center of gravity; and a means for stabilizing the vehicle when the frame is tilting about the chassis and the vehicle is moving, the stabilizing means counteracting the forces acting on the vehicle opposite the turn and to assist in maintaining an upright position while the vehicle is turning.

19. The vehicle of claim 18 wherein said means for tilting the frame includes a tilt mechanism pivotally secured between the frame and the chassis.

20. The vehicle of claim 19 wherein said means to provide vehicle stability comprises:

a pair of protrusions defined on a base of the tilt mechanism;

a pair of legs extending from a subframe member, which is pivotally attached to the tilting mechanism, each leg, of the pair of legs, including a tab defined on an upper portion thereof and a skid pad on a lower portion thereof; and a pair of spring activated return mechanisms separately positioned between the subframe member and one of the legs, of the pair of legs, wherein when said tilt mechanism tilts, a protrusion, of the pair of protrusions, opposite the tilt pushes against one of the tabs to engage and pivot one of the legs such that the skid pad is moved to a lower position, whereby said lowering of one of the legs acts to counterbalance forces exerted on the vehicle opposite the direction of the turn.

* * * * *